US009048578B2

(12) United States Patent
Shimizu et al.

(10) Patent No.: US 9,048,578 B2
(45) Date of Patent: Jun. 2, 2015

(54) LEVER-FITTING-TYPE CONNECTOR

(75) Inventors: Tomohiko Shimizu, Shizuoka (JP); Akinori Tashiro, Shizuoka (JP); Akihiro Tsuruta, Shizuoka (JP); Kazuya Terao, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/129,561

(22) PCT Filed: Jun. 28, 2012

(86) PCT No.: PCT/JP2012/066511

§ 371 (c)(1),
(2), (4) Date: Dec. 27, 2013

(87) PCT Pub. No.: WO2013/005627

PCT Pub. Date: Jan. 10, 2013

(65) Prior Publication Data

US 2014/0113476 A1 Apr. 24, 2014

(30) Foreign Application Priority Data

Jul. 1, 2011 (JP) ..... 2011-147440

(51) Int. Cl.
*H01R 13/629* (2006.01)

(52) U.S. Cl.
CPC .... *H01R 13/62938* (2013.01); *H01R 13/62933* (2013.01)

(58) Field of Classification Search
CPC ..... H01R 13/62938; H01R 13/62933; H01R 13/62977; H01R 13/741; H01R 13/64; H01R 13/74
USPC ..... 439/310, 152, 157, 159–160, 350, 357, 439/372
See application file for complete search history.

(56) References Cited

U.S. PATENT DOCUMENTS 5,971,779 A * 10/1999 Okabe ..... 439/157
6,065,982 A * 5/2000 Okabe ..... 439/157

(Continued)

FOREIGN PATENT DOCUMENTS

JP H10-214635 A 8/1998
JP H10-214653 A 8/1998

(Continued)

OTHER PUBLICATIONS

A copy of Korean office action letter issued on Mar. 19, 2015 in the counterpart Korean patent application.

(Continued)

*Primary Examiner* — Edwin A. Leon
(74) *Attorney, Agent, or Firm* — Marvin A. Motsenbocker; Mots Law, PLLC

(57) ABSTRACT

A boss drawing-in groove of a lever includes: a lever inversion groove portion configured to cause the lever drawing-in boss to rotate the lever in an opposite direction opposite to a fitting rotation direction, in response to an insertion of a male connector into a hood with the lever being positioned at an initial rotation position; a drawing-in groove portion configured to guide the lever drawing-in boss by a rotating operation of the lever in the fitting rotation direction and cause the male connector to be fitted into a female connector; and a lever inertial rotation portion configured to rotate in the fitting rotation direction due to an inertial force of the lever after rotation of the lever in the opposite direction and cause the lever drawing-in boss to move to the drawing-in groove portion.

4 Claims, 20 Drawing Sheets

(56) References Cited

U.S. PATENT DOCUMENTS

| | | | | |
|---|---|---|---|---|
| 6,183,277 | B1 | 2/2001 | Okabe et al. | |
| 6,783,388 | B2 * | 8/2004 | Matsushita | 439/489 |

FOREIGN PATENT DOCUMENTS

| | | | |
|---|---|---|---|
| JP | 2000-091026 | A | 3/2000 |
| JP | 2002-359037 | A | 12/2002 |
| JP | 2003-324824 | A | 11/2003 |
| JP | 2004-311190 | A | 11/2004 |
| JP | 2006-344473 | A | 12/2006 |
| JP | 2009-099469 | A | 5/2009 |
| JP | 2010-097954 | A | 4/2010 |

OTHER PUBLICATIONS

A copy of Japanese office action letter issued on Feb. 3, 2015 in the counterpart Japanese patent application.

* cited by examiner (A)

(B)

(A)

(B)

(A)

(B)

(A)

(B)

(C)

(A)

(B)

(A)

(B)

(A)

(B)

(A)

(B)

LEVER-FITTING-TYPE CONNECTOR

TECHNICAL FIELD

The present invention relates to a lever-fitting-type connector enabling a female connector and a male connector to be fitted to each other through rotating operation of a lever.

BACKGROUND ART

FIG. 1 shows a related lever-fitting-type connector 100 described in Patent Literature 1. The lever-fitting-type connector 100 is provided with a connector body 120 having a female connector 110; a male connector 130, which is a partner connector to be fitted into the female connector 110; and a lever 140, which causes the male connector 130 to be fitted into the female connector 110 through rotating operation.

The female connector 110 has a female connector housing 112 housing terminals 111, and the female connector housing 112 is provided with rotation support shafts 113 on the left and right outside walls thereof so as to protrude. The rotation support shafts 113 are each rendered to be the rotation center of the lever 140.

The male connector 130, being a partner connector, has a male connector housing 131 to be fitted into the female connector housing 112. In the male connector housing 131, partner terminals 132 to be connected to the terminals 111 of the female connector housing 112 are housed. On the left and right outside walls of the male connector housing 131, bosses 133 are provided so as to protrude, and the bosses 133 are engaged to the lever 140.

A pair of left and right arm plates 141 and an operating portion 142 coupling the pair of left and right arm plates 141 on one side are integrally configured to form the lever 140. In the pair of left and right arm plates 141, there are formed cam grooves 143 into which the bosses 133 of the male connector 130 are inserted. Moreover, in the pair of left and right arm plates 141, there are formed support holes 144 into which the rotation support shafts 113 of the female connector 110 are inserted.

The lever-fitting-type connector 100 as described above causes the lever 140 to be mounted to the female connector 110 by inserting the rotation support shafts 113 of the female connector 110 into the support holes 144 of the lever 140. By inserting the bosses 133 into the cam grooves 143 of the lever 140 in this mounting state, the male connector 130 is joined to the lever 140, and the operating portion 142 is operated to cause the lever 140 to be rotated. Since the bosses 133 move along the cam grooves 143 due to rotation of the lever 140, it becomes possible to cause the male connector housing 131 to be fitted into the female connector housing 112.

CITATION LIST

Patent Literature

Patent Literature 1: JP 2009-99469 A

SUMMARY OF INVENTION

However, in the related lever-fitting-type connector 100, the lever 140 is idle-rotated when the lever 140 is operated. When such an idle rotation occurs, a worthless operation force becomes necessary, because it is required to rotate the lever 140 further by the amount of being idle-rotated. In addition, since the range of operating the lever 140 is reduced due to the idle rotation of the lever 140, the operability of the lever 140 is reduced.

It is an object of the present invention to provide a lever-fitting-type connector that enables to reduce the force to be applied to a lever by preventing the lever from being idle-rotated, and thereby causes the operability of the lever to be enhanced.

A lever-fitting-type connector in accordance with some embodiments includes: a female connector including a female connector housing having a terminal of a wire end housed in the female connector housing; a male connector including a male connector housing configured to house a partner terminal of a wire end to be connected to the terminal housed in the female connector housing, the male connector housing fitted into the female connector being configured to connect the terminal of the wire end to the partner terminal of the wire end; a hood for the female connector to be mounted and for the male connector to be inserted; a lever rotatably assembled on the hood and configured to selectively apply a fitting force and a separation force between the male connector and the female connector by a rotating operation of the lever, wherein the male connector includes a lever drawing-in boss, the lever includes a boss drawing-in groove for the lever drawing-in boss to be drawn by a rotating operation of the lever, and the boss drawing-in groove includes a lever inversion groove portion configured to cause the lever drawing-in boss to rotate the lever in an opposite direction opposite to a fitting rotation direction for the male connector to be fitted into the female connector, in response to an insertion of the male connector into the hood with the lever being positioned at an initial rotation position, a drawing-in groove portion configured to guide the lever drawing-in boss by a rotating operation of the lever in the fitting rotation direction and cause the male connector to be fitted into the female connector, and a lever inertial rotation portion provided in between the lever inversion groove portion and the drawing-in groove portion and configured to rotate in the fitting rotation direction due to an inertial force of the lever after rotation of the lever in the opposite direction and cause the lever drawing-in boss to move to the drawing-in groove portion.

According to the aspect, by inserting the male connector into the hood, the lever drawing-in boss of the male connector is drawn into the boss drawing-in groove of the lever, and the lever rotates in the direction opposite to the fitting rotation direction. Accordingly, the idle rotations (lost rotation) of the lever at the occasion of operating the lever is reduced, and it becomes possible to draw the lever drawing-in boss into the boss drawing-in groove at an early stage. The force for inserting the male connector into the hood can thereby be reduced, and the force for operating the lever when causing the male connector to fit into the female connector can also be reduced.

In addition, the lever drawing-in boss and a lever inertial rotation portion of the boss drawing-in groove come into contact with each other due to the push of the male connector, and the lever rotates in the fitting rotation direction by the inertial force thereof. Since the region of operating the lever increases because of this rotation, the operability of the lever is enhanced.

An inner wall of the hood may include a lever temporary engagement arm being flexible and enabling the lever to be engaged at the initial rotation position, the lever may include a lever temporary engagement holding portion configured to temporarily engage with the lever temporary engagement arm and hold the lever at the initial pivot position, the male connector may include a lever temporary engagement release lug configured to warp the lever temporary engagement arm in response to insertion of the male connector into the hood with the lever being positioned at the initial rotation position and release a temporary engagement between the lever temporary engagement arm and the lever temporary engagement holding portion, and the lever drawing-in boss may be positioned at the lever inertial rotation portion upon release of the temporary engagement between the lever temporary engagement arm and the lever temporary engagement holding portion in response to the insertion of the male connector into the hood with the lever being positioned at the initial rotation position.

According to the configuration described above, since the state of temporary engagement between the lever temporary engagement arm and the lever temporary engagement holding portions is released due to the insertion of the male connector into the hood at the state in which the lever is at the initial rotation position and, due to the release, the lever drawing-in boss is positioned at the lever inertial rotation portion, the rotation of the lever in the fitting rotation direction due to inertia can be reliably carried out.

The lever may include a pair of arm plates each having a pivot support axis provided to protrude from an outer peripheral surface of the arm plate, and an operating portion coupling the pair of arm plates and for performing the rotating operation with the operating portion being rotatably supported by the hood, each of the pair of arm plates may include the boss drawing-in groove on toward the inner wall, and the lever inversion groove portion may include a drawing-in inlet for the lever drawing-in boss of the male connector to be inserted, and an inclined wall inclined downward along a direction for the male connector to be fitted into the female connector and configured to be in contact with the lever drawing-in boss inserted from the drawing-in inlet.

According to the configuration described above, since the lever inversion groove portion is provided with the drawing-in inlet to which the lever drawing-in boss of the male connector is inserted, and the inclined wall with which the lever drawing-in boss inserted from the drawing-in inlet is in contact and which inclines downward along the direction in which the male connector is fitted into the female connector, it is possible to reliably rotate the lever in the direction opposite to the fitting rotation direction.

The hood may include a lever lock engagement portion, and the operating portion of the lever may include a lever lock configured to engage with the lever lock engagement portion upon completion of a fit between the male connector and the female connector.

According to the configuration described above, since the lever lock engagement portion is provided in the hood and the lever lock, which is engaged to the lever lock engagement portion, is provided in the lever, the state of fitting of the male connector with the female connector can be reliably locked.

DESCRIPTION OF EMBODIMENTS

Figure 1:
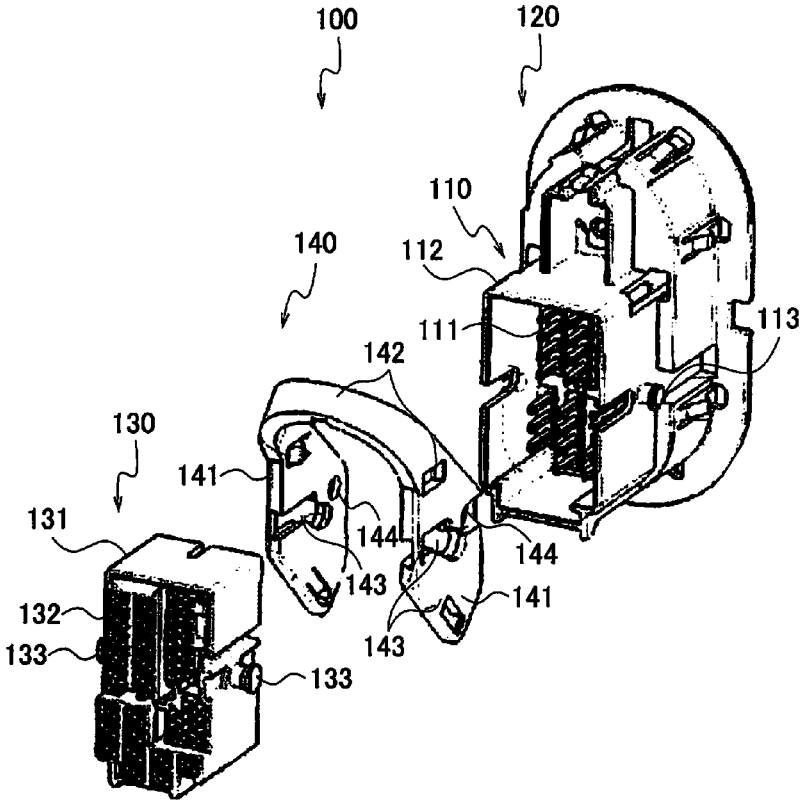
FIG. 1 RELATED ART
FIG. 1 is an exploded perspective view of a related lever-fitting-type connector.
Figure 2:
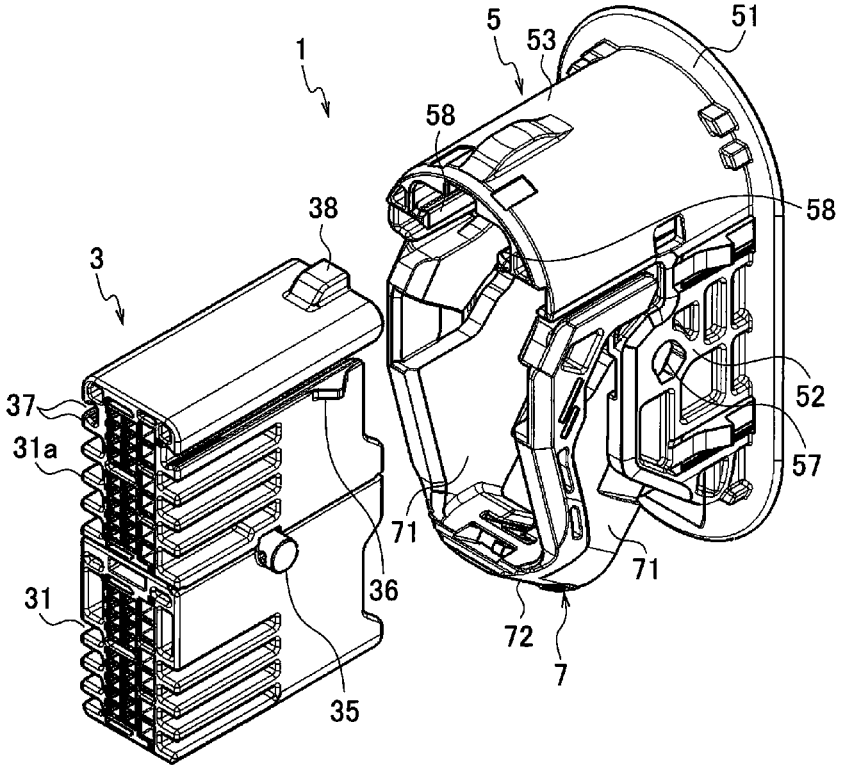
FIG. 2 is a perspective view showing a lever-fitting-type connector of an embodiment of the present invention.
Figure 4:
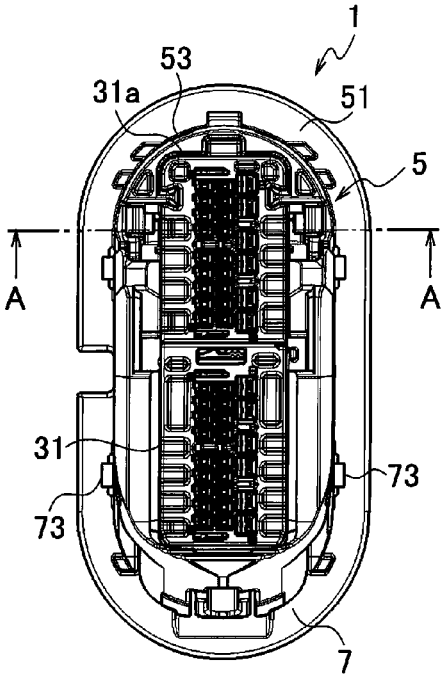
FIG. 4 is an elevation view showing the lever-fitting-type connector.
Figure 5:
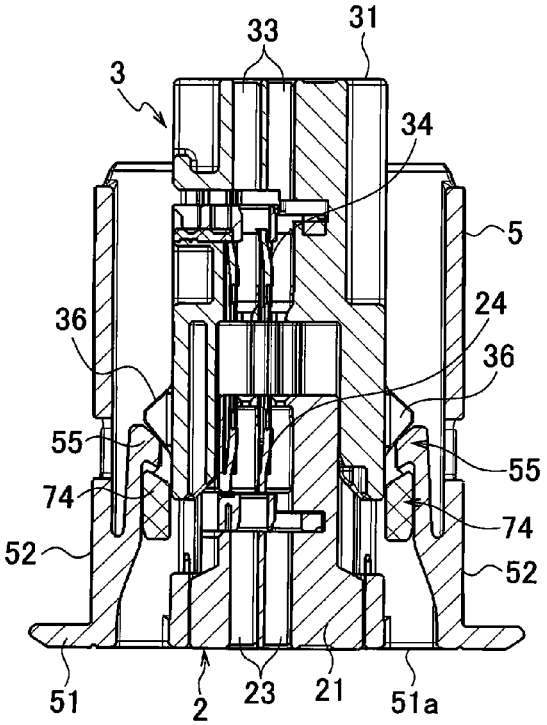
FIG. 5 is a cross-sectional view taken from line A-A of FIG. 4.
Figure 6:
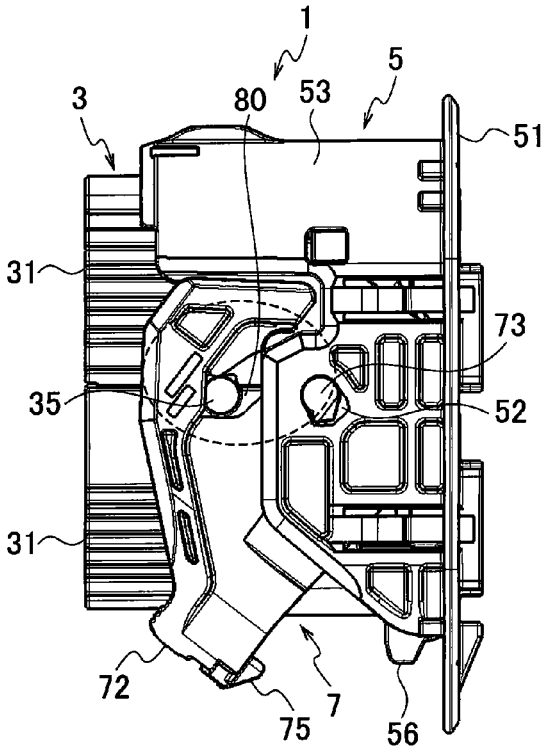
FIG. 6 is a side view showing insertion of a male connector into a hood.
Figure 7:
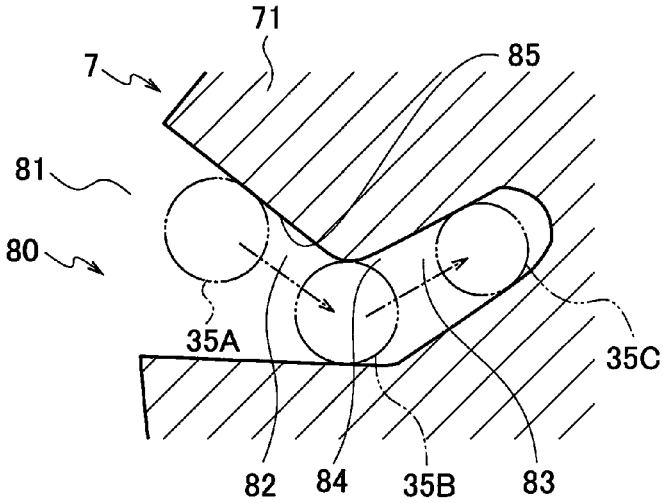
FIG. 7 is a cross-sectional view showing a boss drawing-in groove.

In the following, the present invention will be specifically described according to the embodiment shown in FIG. 2 to FIG. 28(B). FIG. 2 is a perspective view of a lever-fitting-type connector 1 of an embodiment of the present invention, FIG. 3 is an exploded perspective view, FIG. 4 is an elevation view of a hood, FIG. 5 is a cross-sectional view taken from line A-A of FIG. 4, FIG. 6 is a side view of a fitting state, and FIG. 7 is a cross-sectional view of a boss drawing-in groove.

The lever-fitting-type connector 1 is provided with a female connector 2, a male connector 3, a hood 5 and a lever 7.

Figure 3:
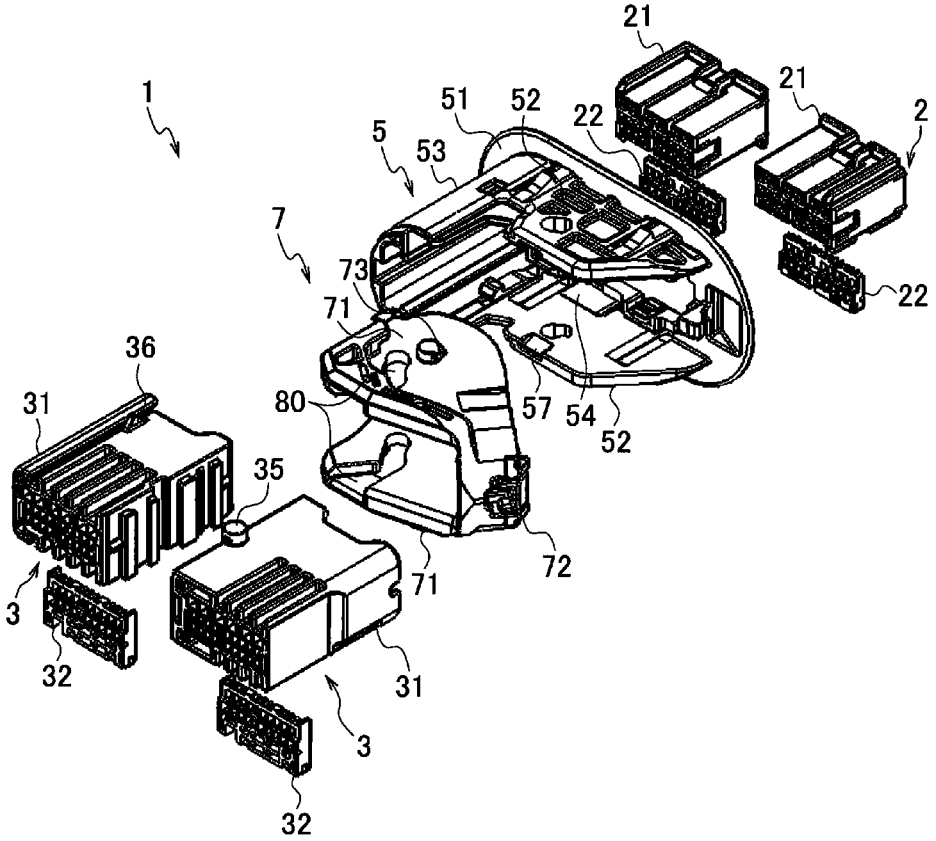
FIG. 3 is an exploded perspective view showing the lever-fitting-type connector.

AS shown in FIG. 3, the female connector 2 includes a plurality (two) of female connector housings 21, and spacers provided in correspondence to the respective female connector housings 21. The female connector housings 21 are each formed in a rectangular box shape, and there are formed a plurality of terminal housing rooms 23 inside thereof by being partitioned as shown in FIG. 5. In the respective terminal housing rooms 23, terminals 24 connected to wire ends are housed. The plurality of female connector housings 21 are mounted to the hood 5 in a state of being assembled.

The male connector 3 has a plurality (two) of male connector housings 31, 31*a* and spacers 32 provided in correspondence to the respective male connector housings 31, 31*a* as shown in FIG. 3. The male connector housings 31, 31*a* are each formed in a rectangular box shape similarly as the female connector housings 21. In addition, in the respective male connector housings 31, 31*a*, there are formed a plurality of terminal housing rooms 33 corresponding to the terminal housing rooms 23 of the female connector housings 21, and partner terminals 34 connected to the terminals 24 of the female connector housings 21 are housed in the respective terminal housing rooms 33 (refer to FIG. 5).

The plurality of male connector housings 31, 31*a* are used after having been assembled along the height direction. In the male connector 3 in which the plurality of male connector housings 31, 31*a* are assembled, there are formed lever drawing-in bosses 35, lever temporary engagement release lugs 36 and rib guide grooves 37 (refer to FIG. 12).

The lever drawing-in bosses 35 draw the male connector 3 in, by being engaged with the lever 7, into the hood 5 through rotating operation of the lever 7, and cause the male connector 3 to be fitted into the female connector 2. The lever drawing-in bosses 35 are formed on the outside of the male connector housing 31 on the other side (the lower side in FIG. 2, the right side in FIG. 3), and are positioned in the boundary portion between the plurality of male connector housings 31, 31*a* when the plurality of male connector housings 31, 31*a* are assembled in the height direction. The lever drawing-in bosses 35 are each formed in the shape of a circular shaft.

The lever temporary engagement release lugs 36 are provided on the outside of the male connector housing 31*a* on one side (the upper side in FIG. 2, the left side in FIG. 3) so as to protrude therefrom. Moreover, the lever temporary engagement release lugs 36 are provided on the outside of the male connector housing 31*a* so as to position on the side of the hood 5. The lever temporary engagement release lugs 36 release the state of temporary engagement between the hood 5 and the lever 7 by causing lever temporary engagement arms 55 of the hood 5 to bend when the male connector 3 is inserted into the hood 5, as described later. The actions of the lever temporary engagement release lugs 36 and the lever drawing-in bosses 35 will be described later according to FIG. 21(A) to FIG. 28(B).

The rib guide grooves 37 are formed in the male connector housing 31*a* on the one side (the upper side in FIG. 2, the left side in FIG. 3). The rib guide grooves 37 are provided on the both sides of the end portion (the upper part in FIG. 2) of the male connector housing 31*a* in the state of extending along the longitudinal direction of the male connector housing 31*a* (refer to FIG. 12), which is the fitting direction of the male connector 3 (refer to FIG. 2). The configuration and action of the rib guide grooves 37 will be described later according to FIG. 12.

Incidentally, there is formed a guide projection portion 38 on the top wall portion of the male connector housing 31*a* on the one side (refer to FIG. 2). The guide projection portion 38 slides on the inner face of the hood 5 to guide the fitting of the male connector 3 when the male connector 3 is fitted to the hood 5.

The male connector 3 is inserted to and the female connector 2 is mounted in the hood 5, and the hood 5 has a collar-like plate portion 51, a pair of support wall portions 52 and a coupling cover portion 53.

The collar-like plate portion 51 is formed to be like a plate in an oval shape, and is positioned on the opposite side with respect to the side on which the male connector 3 is fitted. To the collar-like plate portion 51, the female connector 2 is mounted. For this reason, a mounting opening portion 51*a* (refer to FIG. 5) for mounting the female connector 2 is formed in the collar-like plate portion 51.

The pair of support wall portions 52 is provided so as to protrude toward the male connector 3 from one face side (the face on the side of the male connector 3) of the collar-like plate portion 51. The pair of support wall portions 52 have the lever 7 rotatably attached and support the rotation of the lever 7.

The coupling cover portion 53 couples the pair of support wall portions 52. In the present embodiment, the coupling cover portion 53 couples the end portions on one side of the pair of support wall portions 52 (the end portion on the upper side in FIG. 2, the end portion on the left side in FIG. 3). The coupling cover portion 53 extends from one face side of the collar-like plate portion 51 (the face on the side of the male connector 3) toward the male connector 3 in the form of an arc, and is configured so as to cover the male connector 3 to be fitted to the hood 5.

There are formed lever-falling prevention walls 54 on the collar-like plate portion 51. The lever-falling prevention walls 54 are provided so as to protrude in the same direction as the pair of support wall portions 52 as shown in FIG. 15 to FIG. 18. The lever-falling prevention walls 54 prevent the lever 7 from falling to the inner side, and the configuration and action will be described later according to FIG. 14 to FIG. 18.

The pair of support wall portions 52 is provided with lever temporary engagement arms 55, lever lock engagement portions 56 and rotation support shaft support holes 57.

The lever temporary engagement arms 55 are temporarily engaged by lever temporary engagement holding portions 74 (refer to FIG. 5), are each formed so as to rise from the inner wall of the support wall portion 52 toward the lever 7 like a cantilever (refer to FIG. 5), and each have bendable elasticity. The lever temporary engagement arms 55 engage the lever 7 at an initial rotation position in the beginning of inserting the male connector 3 into the hood 5. The action of the lever temporary engagement arms 55 will be described later according to FIG. 21(A) to FIG. 28(B).

The lever lock engagement portions 56 are provided below the respective support wall portions 52 (refer to FIG. 6), and the lever 7 is engaged when the lever 7 is subjected to rotating operation. Rotation of the lever 7 is locked by the engagement.

The rotation support shaft support holes 57 support the rotation of the lever 7 by that rotation support shafts 73 of the lever 7 (refer to FIG. 3) are inserted so as to be rotatable, and are formed so as to pierce the pair of support wall portions 52, respectively.

Figure 10:
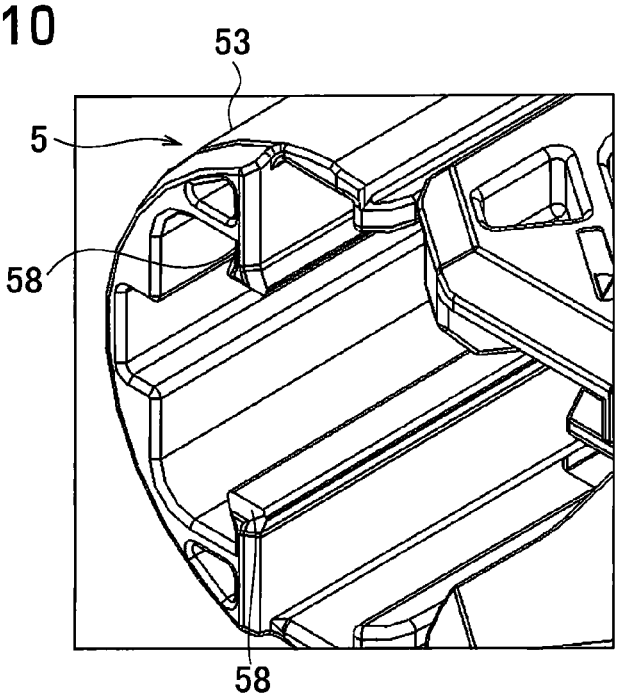
FIG. 10 is a perspective view showing guide ribs.

In the coupling cover portion 53 of the hood 5, there are formed guide ribs 58 corresponding to the rib guide grooves 37 formed in the male connector 3. As shown in FIG. 2 and FIG. 10, the guide ribs 58 are formed on the side of the coupling cover portion 53 to which the male connector 3 is fitted in (the inner side of the coupling cover portion 53). Moreover, the guide ribs 58 are formed in the coupling cover portion 53 so as to extend in the fitting direction of the male connector 3. These guide ribs 58 and the rib guide grooves 37 of the male connector 3 described above constitute a fitting guide portion 9 that guides the male connector 3 to the normal fitting direction with respect to the female connector 2 (refer to FIG. 8).

The lever 7 is subjected to rotating operation in order to cause the male connector 3 to be fitted into the female connector 2. The lever 7 is rotatably assembled on the hood 5, and causes a fitting force and a separation force (selectively) to be applied between the male connector 3 and the female connector 2 by the rotating operation of the lever 7. As shown in FIG. 2 and FIG. 4, the lever 7 includes a pair of left and right arm plates 71 and an operating portion 72.

The pair of arm plates 71 is rotatably supported at the pair of support wall portions 52 of the hood 5, and the rotation support shafts 73 are provided on the outer faces of the arm plates 71 so as to protrude, respectively. By inserting the rotation support shafts 73 into the rotation support shaft support holes 57 of the pair of support wall portions 52, the pair of arm plates 71 (that is, the lever 7) are rotatably supported at the pair of support wall portions 52.

In the pair of arm plates 71, there are further provided the lever temporary engagement holding portions 74 and the boss drawing-in grooves 80.

The lever temporary engagement holding portions 74 are engaged with the lever temporary engagement arms 55 formed on the support wall portions 52 of the hood 5, and the lever 7 is held at the initial rotation position by that the lever temporary engagement arms 55 are temporarily engaged. This will be described later according to FIG. 21(A) to FIG. 28(B).

The boss drawing-in grooves 80 are cam-like grooves into which the lever drawing-in bosses 35 protruding from the outer face of the male connector (refer to FIG. 2 and FIG. 3) are drawn. The boss drawing-in grooves 80 are provided so as to position on the side in the inner wall side of the pair of arm plates 71 on which the male connector 3 is fitted as shown in FIG. 3. FIG. 7 shows the boss drawing-in groove 80, which includes a lever inversion groove portion 82 and a drawing-in groove portion 83 continued to the lever inversion groove portion 82, and is formed in a substantially doglegged shape upwardly bending (a substantially L-character shape; more or less opened shape with respect to L-character in the present embodiment).

The lever inversion groove portion 82 has a drawing-in inlet 81, which opens such that the lever drawing-in boss 35 (refer to FIG. 2 and FIG. 3) is drawn in, and an inclined wall 85 continued to the drawing-in inlet 81. In the state when the lever 7 is at the initial rotation position and the male connector 3 is inserted into the hood 5, the lever drawing-in bosses 35 of the male connector 3 are drawn in the lever inversion groove portions 82. Due to the drawing-in, the lever inversion groove portions 82 cause the lever 7 to rotate in the direction opposite to the fitting rotation direction of causing the male connector 3 to be fitted into the female connector 2. The inclined wall 85 is configured so as to be inclined downward along the direction in which the male connector 3 is fitted into the female connector 2, and gets directly contacted by the lever drawing-in boss 35 when the lever drawing-in boss 35 is drawn in from the drawing-in inlet 81. Due to the direct contact, rotation of the lever 7 in the direction opposite to the fitting rotation direction described above is carried out.

The drawing-in groove portion 83 continues after the lever inversion groove portion 82 in the state of bending upward. By conducting rotating operation of the lever 7 in the fitting rotation direction, the lever drawing-in bosses 35 are drawn in the drawing-in groove portions 83. The drawing-in groove portions 83 thereby cause the male connector 3 to be fitted into the female connector 2 by guiding the lever drawing-in bosses 35. The rotating operation of the lever 7 in the fitting rotation direction is conducted after having rotated in the direction opposite to the fitting rotation direction by means of the lever inversion groove portions 82.

A lever inertial rotation portion 84 is formed in between the lever inversion groove portion 82 and the drawing-in groove portion 83. The lever inertial rotation portion 84 is the portion at which the lever 7 rotates in the fitting rotation direction by the inertial force of the lever itself, which is conducted after the lever 7 has rotated in the direction opposite to the fitting rotation direction, and the lever drawing-in bosses 35 are guided to the drawing-in groove portions 83. At such an occasion in which the lever drawing-in bosses 35 are positioned at the lever inertial rotation portions 84, the temporary engagement between the lever temporary engagement arms 55 of the hood 5 and the lever temporary engagement holding portions 74 of the lever 7 is in a state of being disengaged. Incidentally, the disengagement of the temporary engagement is conducted by inserting the male connector 3 into the hood 5.

Lever locks 75 are provided in the operating portion 72 of the lever 7 (refer to FIG. 6). The lever locks 75 are in correspondence to the lever lock engagement portions 56 of the hood 5 by being provided in the operating portion 72. And, when the lever locks 75 are engaged with the lever lock engagement portions 56, rotation of the lever 7 is locked, and the state of fitting the male connector 3 to the female connector 2 is locked.

Next, the action of fitting the male connector 3 to the female connector 2 will be described according to FIG. 7, FIG. 21(A) to FIG. 28(B). In FIG. 21(A) to FIG. 28(B), drawings corresponding to FIG. 6 are shown in (A), and drawings corresponding to the view taken from line A-A of FIG. 4 are shown in (B).

FIGS. 21(A) and 21(B) show the beginning of insertion of the male connector 3 into the hood 5, which is in a state of temporary engagement in which the lever temporary engagement holding portions 74 of the lever 7 is held by the lever temporary engagement arms 55 of the hood 5. When the lever 7 is not at the position of drawing the lever drawing-in bosses 35 of the male connector 3, it is possible to push out the male connector 3 in the direction opposite to the insertion direction by means of the boss drawing-in grooves 80 formed in a substantially doglegged shape.

Upon insertion of the male connector 3 into the hood 5, the lever drawing-in bosses 35 of the male connector 3 are drawn into the boss drawing-in grooves 80 of the lever 7 as shown in FIGS. 22(A) and 22(B). The drawn lever drawing-in bosses 35 is in contact with the inclined walls 85 of the lever inversion groove portions 82 (the position of reference numeral 35A in FIG. 7). In the contact, the lever drawing-in bosses 35 are positioned at lever inversion groove portions 82, and the lever 7 rotates in the direction opposite to the fitting rotation direction for causing the male connector 3 to be fitted into the female connector 2, having the rotation support shafts 73 as the center. Arrow L in FIG. 22(A) indicates the direction opposite to the fitting rotation direction.

By further continuing the insertion of the male connector 3, the lever drawing-in bosses 35 move to the ends of the lever inversion groove portions 82 as shown in FIG. 23(A), and the lever 7 rotates in the direction opposite to the fitting rotation direction (L direction) during the movement. Even after the lever drawing-in bosses 35 have gone beyond the crest of the substantially doglegged shape of the boss drawing-in grooves 80, the lever 7 keeps the state of having rotated in the direction opposite to the fitting rotation direction (L direction). During this period, the state of waiting disengagement of temporary engagement, in which the lever temporary engagement holding portions 74 of the lever 7 separate gradually from the lever temporary engagement arms 55 of the hood 5, develops.

FIGS. 24(A) and 24(B) show the state in which the male connector 3 is pushed into the hood 5 continuously thereto. Due to being pushed in by the male connector 3, the lever temporary engagement release lugs 36 of the male connector 3 contact the lever temporary engagement arms 55 of the hood 5, which causes the lever temporary engagement arms 55 to be bent so as to separate from the lever temporary engagement holding portions 74 of the lever 7. The temporary engagement of the lever 7 is thereby disengaged. By the disengagement of the temporary engagement, the operation of rotating the lever 7 becomes enabled. At this time, the operation region for the lever 7 is rendered to be the operation region 76*a* shown in FIG. 24(A). As shown in FIG. 24(C) by being enlarged, since the boss drawing-in groove 80 is configured in the substantially doglegged shape allowing the lever 7 to be able to rotate in the direction opposite to the fitting rotation direction (L direction), idle rotations are lessened and the pushing in of the lever 7 is enabled from an early stage as compared with related techniques.

At this time, the lever drawing-in bosses 35 of the male connector 3 have reached the lever inertial rotation portions 84 in the boss drawing-in groove 80 (the position of reference numeral 35B in FIG. 7). And, the lever 7 rotates in the fitting rotation direction, which is the opposite direction with respect to arrow L, as shown in FIG. 25(A) due to the inertial force of the lever itself at the time when the temporary engagement of the lever 7 is disengaged. At the time, the lever drawing-in bosses 35 are in contact with the boss drawing-in grooves 80 due to the inertial force of the lever itself at the time when the temporary engagement of the lever 7 is disengaged.

FIGS. 26(A) and 26(B) show the state in which the lever 7 is rotated in the fitting rotation direction from the state of FIGS. 25(A) and 25(B). Since the lever 7 has rotated in the fitting rotation direction by the inertial force due to that the lever drawing-in bosses 35 have reached the lever inertial rotation portions 84, the operation region 76 for the lever 7 is increased as compared with the operation region (region before having rotated in the fitting rotation direction due to inertia) 76*a* in FIG. 24(A). As described above, since the operation region for the lever 7 is increased due to that the lever 7 rotates before the lever 7 is operated, the operation ability of the lever 7 is improved.

In FIG. 26(A), the operating portion 72 of the lever 7 is operated by being pressed in the direction of arrow M by a finger 8. Due to the press operation in the direction M, the lever 7 rotates in the fitting rotation direction, having the rotation support shafts 73 as the center. Due to the operation for the lever 7, the lever drawing-in bosses 35 of the male connector 3 are drawn to the drawing-in groove portions 83 in the boss drawing-in grooves 80 (the position of reference numeral 35C in FIG. 7). Then, by further pressing the lever 7 so as to rotate to the end portion in the fitting rotation direction, the lever locks 75 are engaged with the lever lock engagement portions 56 of the hood 5 to halt the rotation, and the male connector 3 is simultaneously engaged with the female connector 2 to lock the fitting state. At this time, the lever drawing-in bosses 35 reach the end portion of the drawing-in groove portions 83.

In the structure as described above, since the lever 7 rotates in the direction opposite to the fitting rotation direction by inserting the male connector into the hood 5, idle rotations (lost rotations) of the lever 7 when the lever 7 is operated is reduced, and the lever drawing-in bosses 35 can be drawn into the boss drawing-in grooves 80 in an early stage. Accordingly, the force of inserting the male connector 3 into the hood 5 for fitting to the female connector 2 can be reduced and the operation force applied to the lever 7 can be also reduced.

Moreover, due to pressing of the male connector 3, the lever drawing-in bosses 35 and the lever inertial rotation portions 84 of the boss drawing-in grooves 80 come into contact with each other, and the lever 7 rotates in the fitting rotation direction due to an inertial force. Accordingly, the operation region for the lever 7 is increased and the operation ability of the lever 7 is improved.

In addition, in the beginning of insertion of the male connector 3, if the lever 7 is operated to rotate, it is possible to push out the male connector 3, because the lever drawing-in bosses 35 are not drawn into the boss drawing-in grooves 80. An abnormal event can thereby be visually confirmed.

The fitting guide portion 9 is provided for the fitting of the male connector 3 to the female connector 2 described above in the present embodiment (refer to FIG. 8). The fitting guide portion 9 includes the guide ribs 58 and the rib guide grooves 37 as described above.

Figure 12:
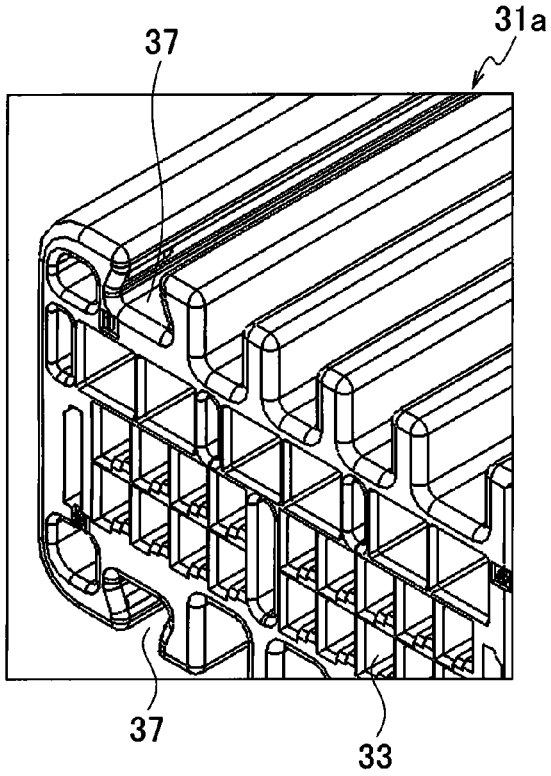
FIG. 12 is a perspective view showing rib guide grooves.

The pair of guide ribs 58 are formed in the inner wall of the coupling cover portion 53 of the hood 5 as shown in FIG. 2, and the pair of rib guide grooves 37 are formed in the both left and right side walls of the male connector housing 31*a* on the one side as shown in FIG. 2 and FIG. 12. These guide ribs 58 and rib guide grooves 37 are provided on the opposite side of the operating portion 72 by interposing the rotation support shafts 73 (rotation support shaft support holes 57) as shown in FIG. 8.

Further, these guide ribs 58 and rib guide grooves 37 extend along the fitting direction of the male connector 3, and the hood guide ribs 58 are inserted into the rib guide grooves 37 at the occasion of fitting the male connector 3 into the female connector 2. Then, the male connector 3 moves in the fitting direction under the state in which the guide ribs 58 have been inserted into the rib guide grooves 37, and the guide ribs 58 slide relative to the rib guide grooves 37. The guide ribs 58 and the rib guide grooves 37 thereby guide the male connector 3 in the normal fitting direction with respect to the female connector 2.

Figure 11:
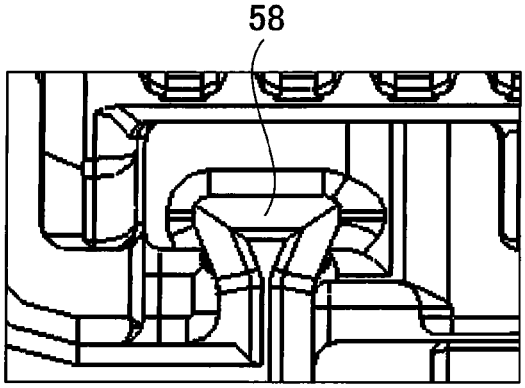
FIG. 11 is an elevation view showing the guide rib.
Figure 13:
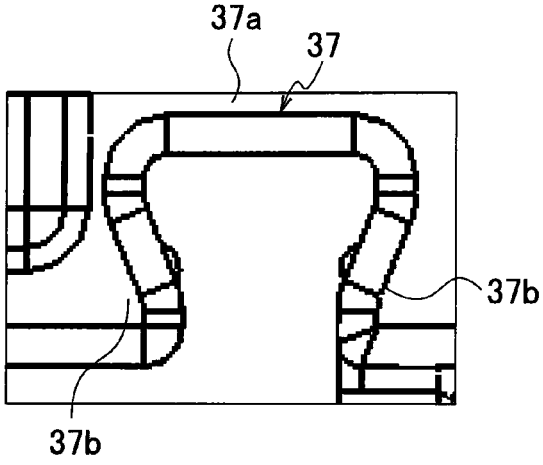
FIG. 13 is an elevation view showing the rib guide groove.

The rib guide groove 37 is formed to have the cross-section of a dovetail groove as shown in FIG. 13. That is, the rib guide groove 37 is formed in such a shape that the top end portion 37*a* is wide and the base portion 37*b* is narrow. In contrast thereto, the guide rib 58 is formed by following the cross-sectional shape of the rib guide groove 37 as shown in FIG. 11. The guide ribs 58 are thereby inserted into the rib guide grooves 37 without coming off from the rib guide grooves 37. Accordingly, since the guide ribs 58 and the rib guide grooves 37 are dovetailed to each other, the rib guide grooves 37 are prevented from being opened, and the guide ribs 58 do not come off from the rib guide grooves 37 even though a force in the drawing direction (force in the direction of arrow D in FIG. 9) is applied when the lever 7 is operated, which results in a stable state of attaching the male connector 3 to the hood 5.

Figure 8:
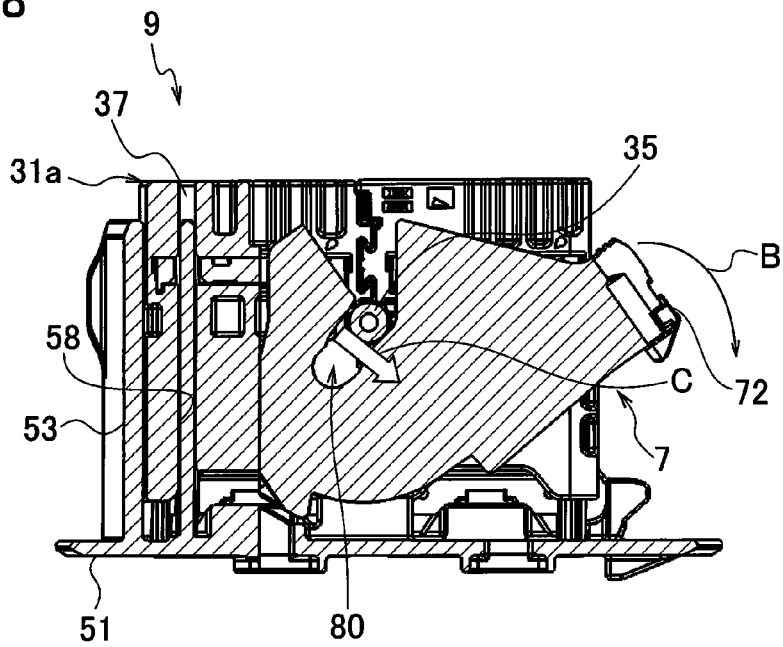
FIG. 8 is a cross-sectional view showing a fitting guide portion in an embodiment of the present invention.
Figure 9:
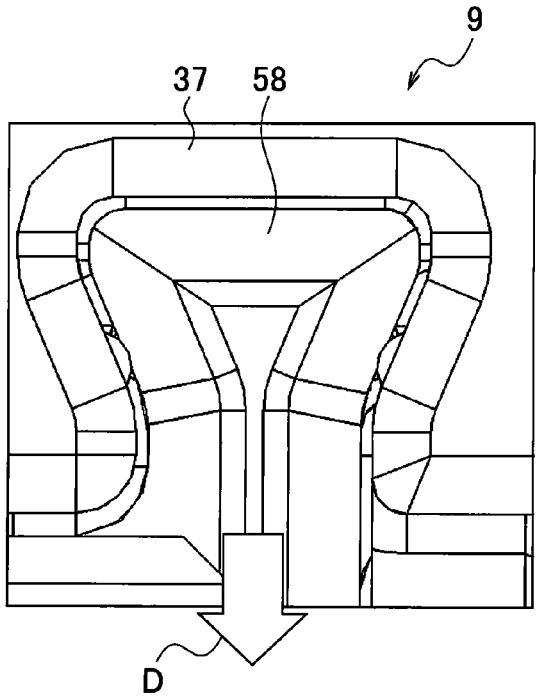
FIG. 9 is an enlarged elevation view showing the fitting guide portion.

When the hood 5 is operated so as to rotate in the direction of arrow B shown in FIG. 8 in order to cause the male connector 3 to be fitted into the female connector 2, since the lever drawing-in bosses 35 of the male connector 3 have been drawn in the boss drawing-in grooves 80 of the lever 7, a force inclining to the direction of arrow C acts on the male connector 3 (connector housing 31*a*). However, since the guide ribs 58 of the hood 5 have been inserted into the rib guide grooves 37 of the male connector 3 and they mutually slide under this state of insertion, it is possible to prevent the male connector 3 (connector housing 31*a*) from inclining. Accordingly, it is possible to insert the male connector 3 into the hood 5 with a small insertion force.

In addition, since the guide ribs 58 of the hood 5 have been inserted into the rib guide grooves 37 of the male connector 3 and are engaged with each other, the state in which the hood 5 is supported by the male connector 3 develops, and the male connector 3 can be inserted smoothly into the hood 5 without causing the hood 5 to be opened when the lever 7 is operated.

Moreover, since the male connector 3 moves in the fitting direction under the state in which the guide ribs 58 have been inserted into the rib guide grooves 37, the hitting at the time of fitting can be prevented.

Incidentally, although the rib guide grooves 37 are formed in the male connector 3 and the guide ribs 58 are formed in the hood 5 in the present embodiment, the rib guide grooves 37 may be formed in the hood 5 and the guide ribs 58 may be formed in the male connector 3.

Next, the lever-falling prevention walls 54 are described. As described above, the lever-falling prevention walls 54 are formed in the collar-like plate portion 51 of the hood 5 so as to extend in the same direction as the pair of support wall portions 52 of the hood 5.

Figure 14:
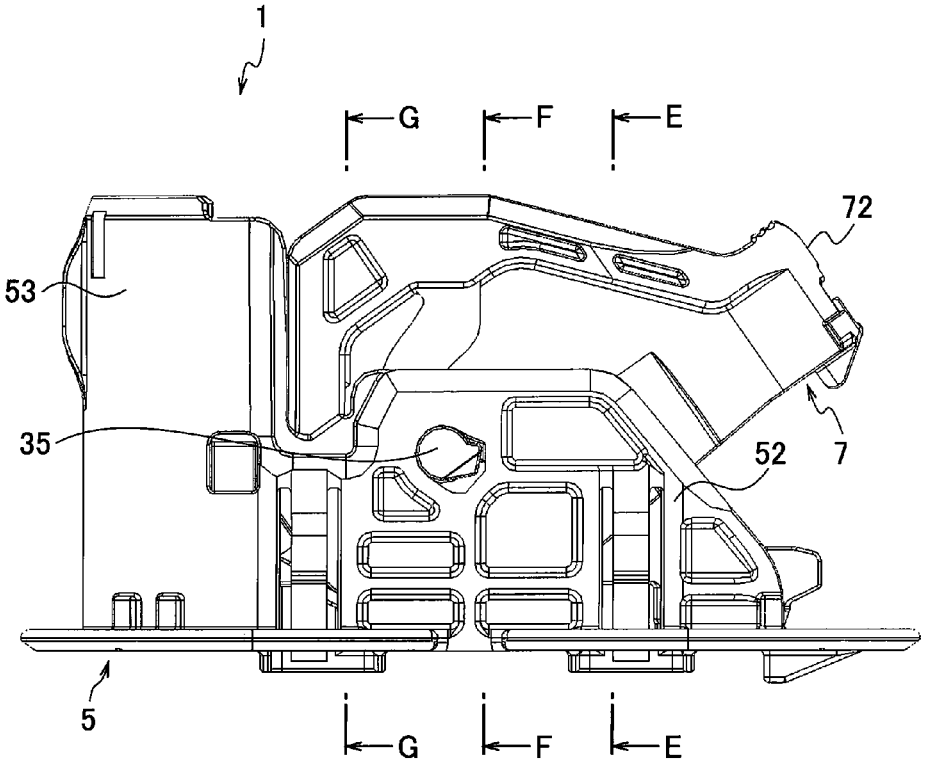
FIG. 14 is a side view for showing the place of forming lever-falling prevention walls.
Figure 15:
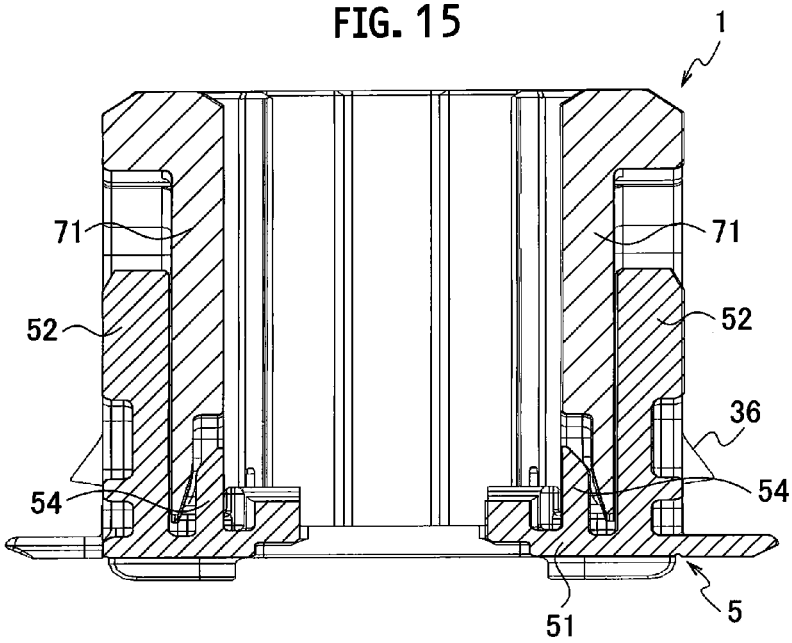
FIG. 15 is a cross-sectional view taken from line E-E of FIG. 14.
Figure 16:
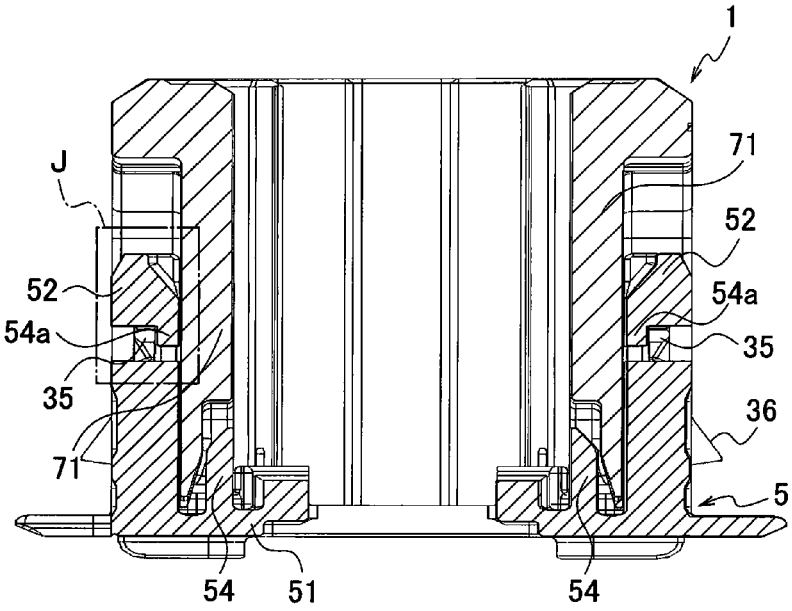
FIG. 16 is a cross-sectional view taken from line F-F of FIG. 14.
Figure 17:
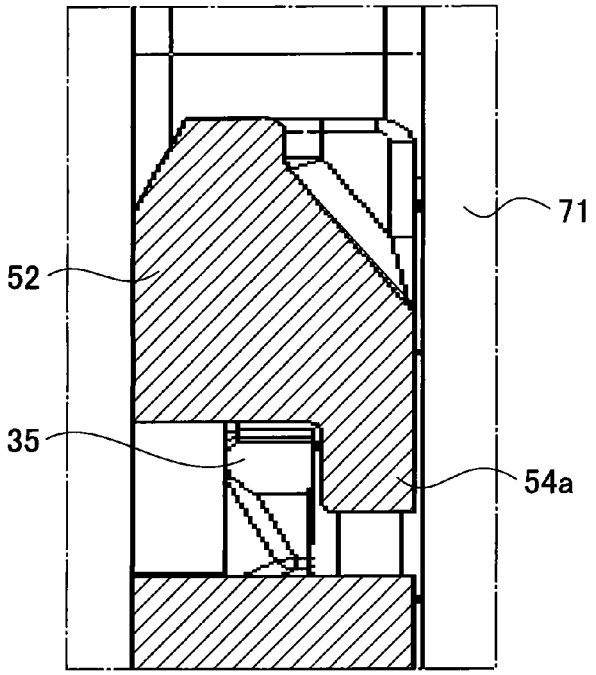
FIG. 17 is an enlarged cross-sectional view of part J in FIG. 16.
Figure 18:
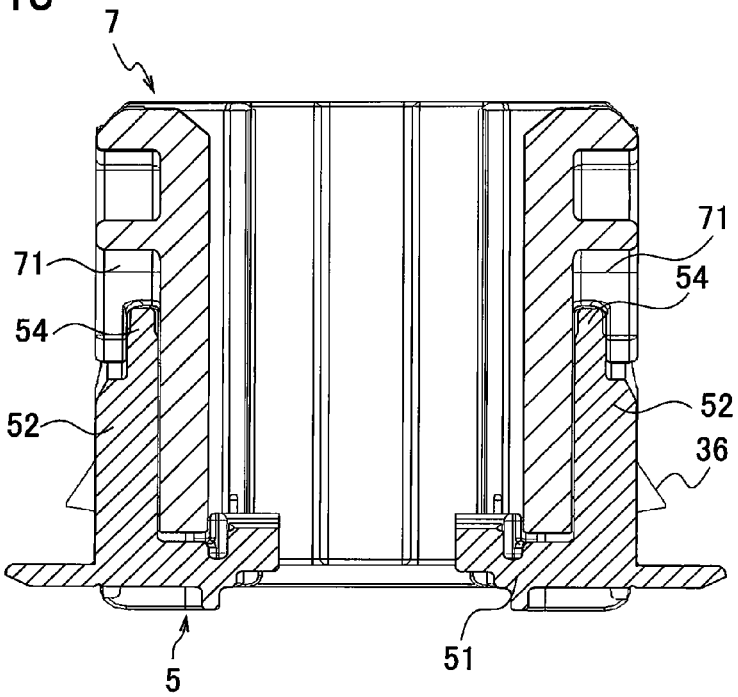
FIG. 18 is a cross-sectional view taken from line G-G of FIG. 14.

FIG. 15 is a cross-sectional view taken from line E-E of FIG. 14, FIG. 16 is a cross-sectional view taken from line F-F, FIG. 18 is a cross-sectional view taken from line G-G, and FIG. 17 is an enlarged cross-sectional view of part J in FIG. 16. On the sides of the operating portion 72 and the lever drawing-in bosses 35 of the lever 7, lever-falling prevention walls 54 rise directly from the collar-like plate portion 51 of the hood 5 in substantially parallel to the support wall portions 52 of the hood 5 as shown in FIG. 15 and FIG. 16. The lever-falling prevention walls 54 are positioned at the inner side of the pair of arm plates 71 of the lever 7, and support the arm plates 71 from the inner side.

On the other hand, on the side of the coupling cover portion 53 of the hood 5, the lever-falling prevention walls 54 are formed stepwise in the top end portions of the support wall portions 52 extending from the collar-like plate portion 51 and further extend from the top end portions of the support wall portions 52 toward the wall portions 52 as shown in FIG. 18. Also in FIG. 18, the lever-falling prevention walls 54 are positioned on the inner side of the pair of arm plates 71 of the lever 7 and support the arm plates 71 from the inner side.

As described above, the lever-falling prevention walls 54 are configured so as to support the arm plates 71 from the inner side thereof at plural places on the pair of arm plates 71 of the lever 7. The pair of arm plates 71 can be prevented from falling to the inner side by that the lever-falling prevention walls 54 support the pair of arm plates 71 from the inner side thereof as described above. Accordingly, the arm plates 71 do not fall to the inner side when the lever 7 is operated to rotate, and it is possible to insert the male connector 3 into the hood 5 with a small force. Moreover, since the state in which the pair of arm plates 71 are supported by the lever-falling prevention walls 54 develops and the male connector 3 moves in the fitting direction due to rotation of the lever 7 under this state, the hitting at the time of fitting can be prevented.

FIG. 16 and FIG. 17 show a structure in which lever-falling prevention sub-walls 54*a* are further provided in addition to the above lever-falling prevention walls 54. The lever-falling prevention sub-walls 54*a* are formed integrally with the pair of support wall portions 52 of the hood 5, and are inserted in between the pair of arm plates 71 of the lever 7 and the lever drawing-in bosses 35 of the male connector 3. The lever-falling prevention sub-walls 54*a* support the pair of arm plates 71 of the lever 7 from the outer sides thereof, and function so as to prevent the arm plates 71 from falling outward. Accordingly, the portion around the lever drawing-in boss 35 is configured such that falling of the arm plates 71 to the inner and outer sides is prevented by the lever-falling prevention walls 54 as well as by the lever-falling prevention sub-walls 54*a*.

Figure 19:
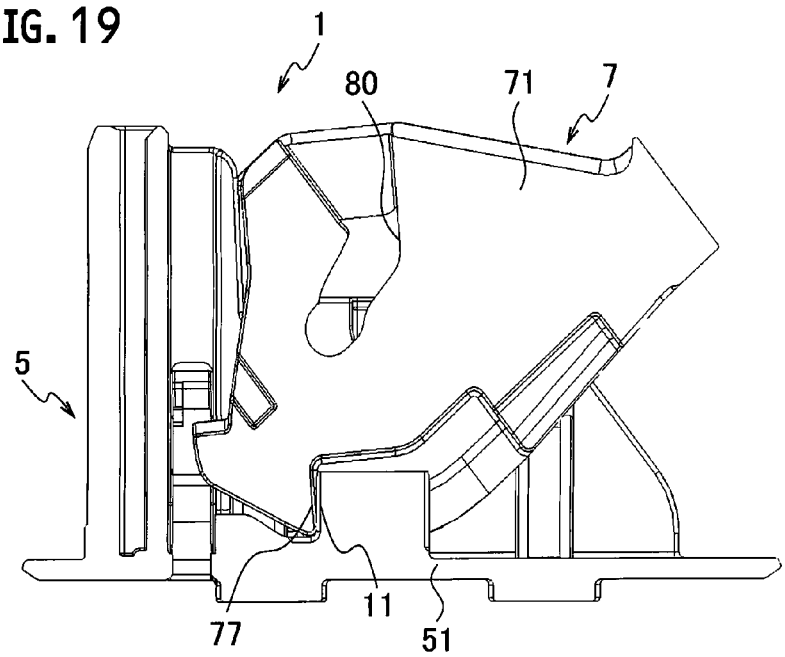
FIG. 19 is a cross-sectional view showing a reverse rotation prevention portion.
Figure 20:
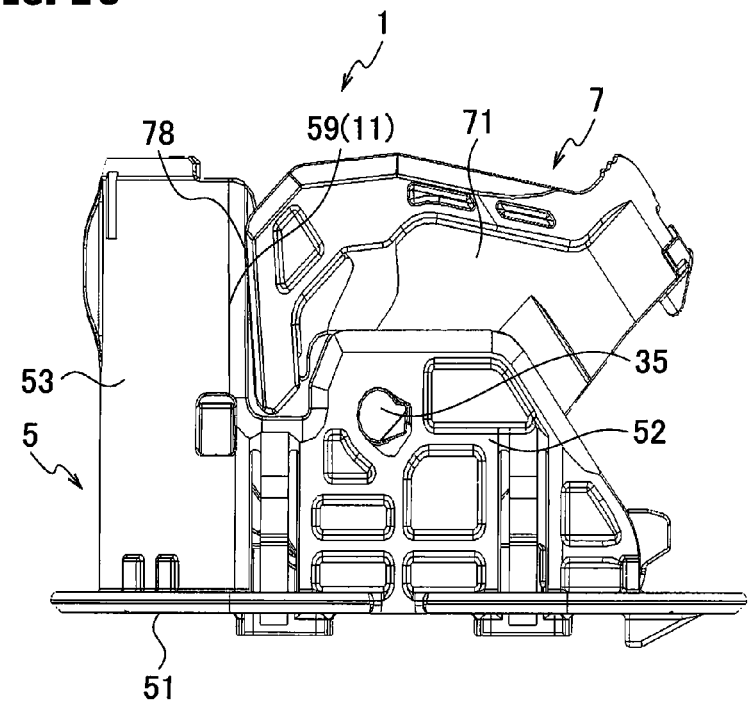
FIG. 20 is a side view showing another reverse rotation prevention portion.
Figure 21:
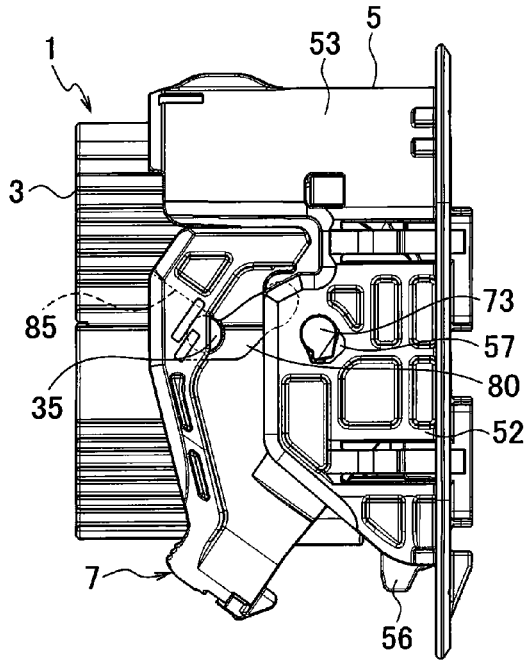
FIGS. 21(A) and 21(B) are a side view and cross-sectional view respectively showing the beginning of insertion (action 1) of a male connector.
Figure 21:
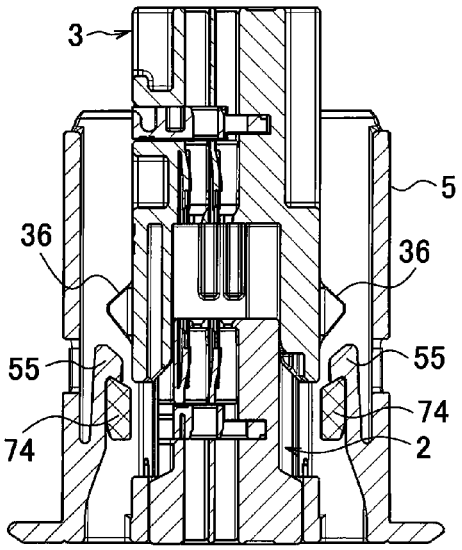
Figure 22:
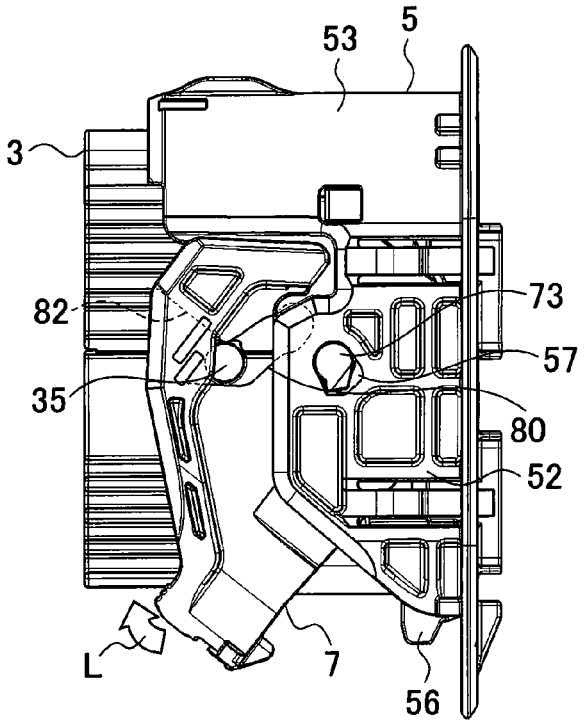
FIGS. 22(A) and 22(B) are a side view and cross-sectional view respectively showing the insertion (action 2) of the male connector following FIGS. 21(A) and 21(B).
Figure 22:
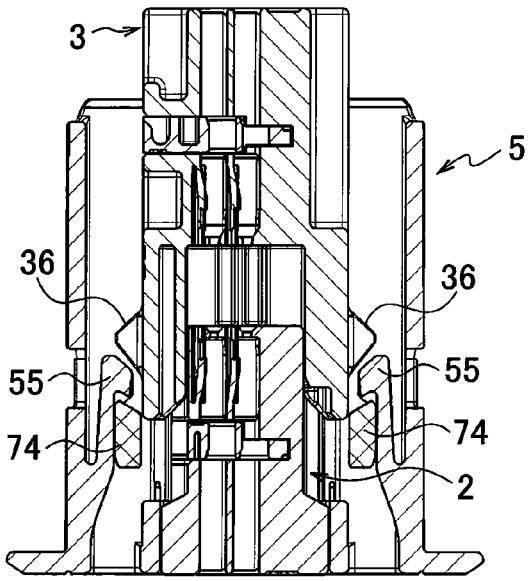
Figure 23:
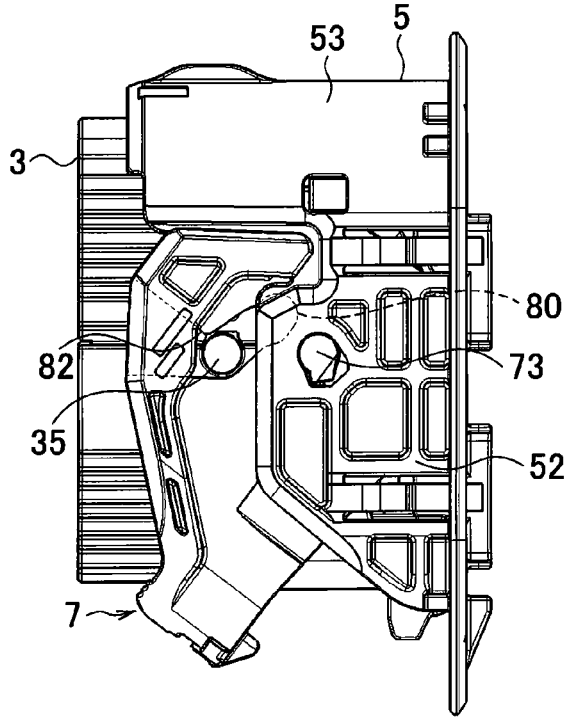
FIGS. 23(A) and 23(B) are a side view and cross-sectional view respectively showing the insertion (action 3) of the male connector following FIGS. 22(A) and 22(B).
Figure 23:
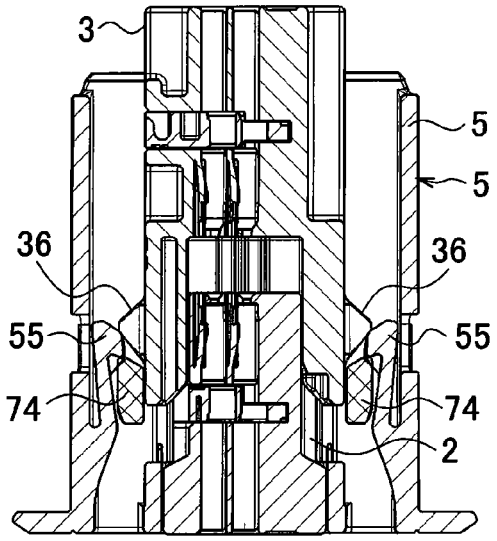
Figure 24:
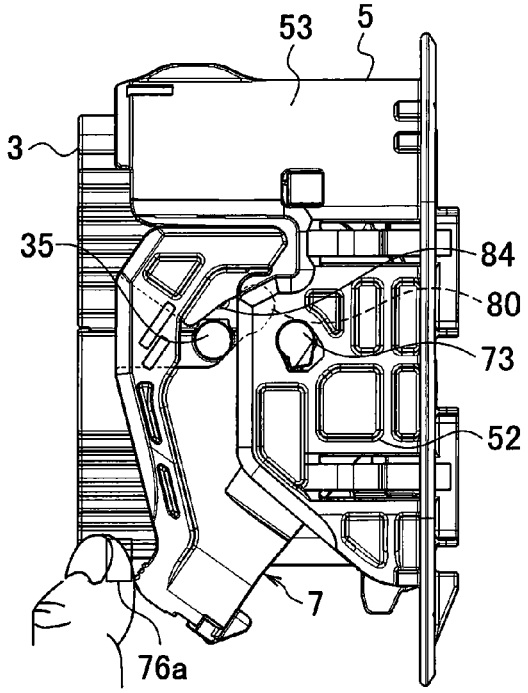
FIGS. 24(A), 24(B) and 24(C) are a side view and cross-sectional views respectively showing a state in which temporary engagement is released (action 4) by insertion of the male connector.
Figure 24:
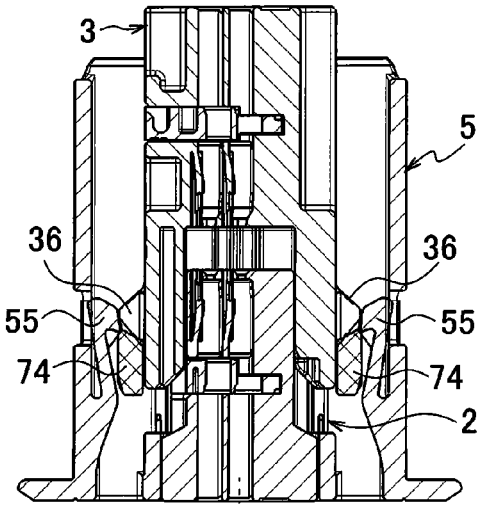
Figure 24:
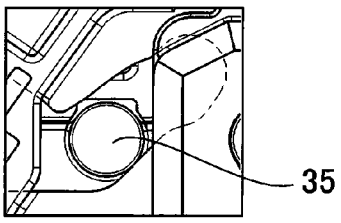
Figure 25:
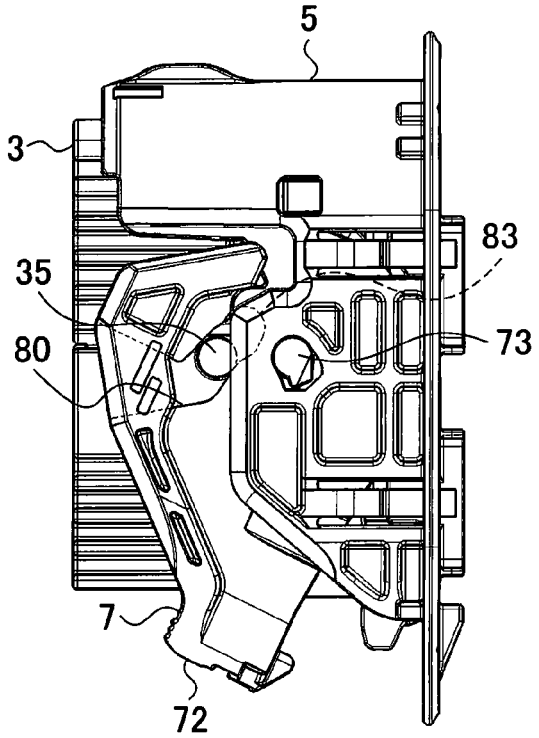
FIGS. 25(A) and 25(B) are a side view and cross-sectional view respectively showing a state in which the lever rotates (action 5) due to an inertial force.
Figure 25:
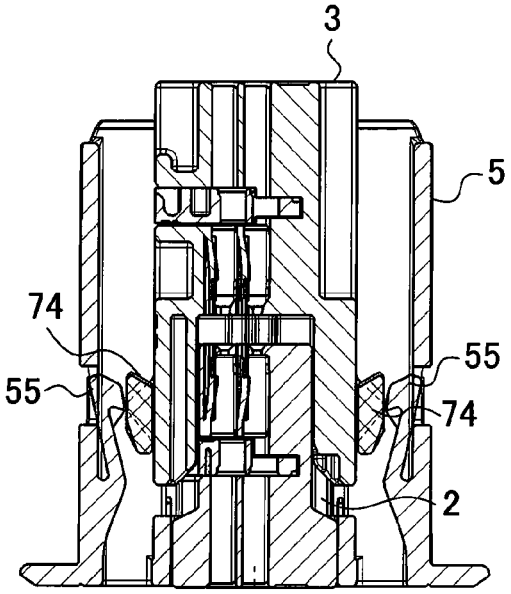
Figure 26:
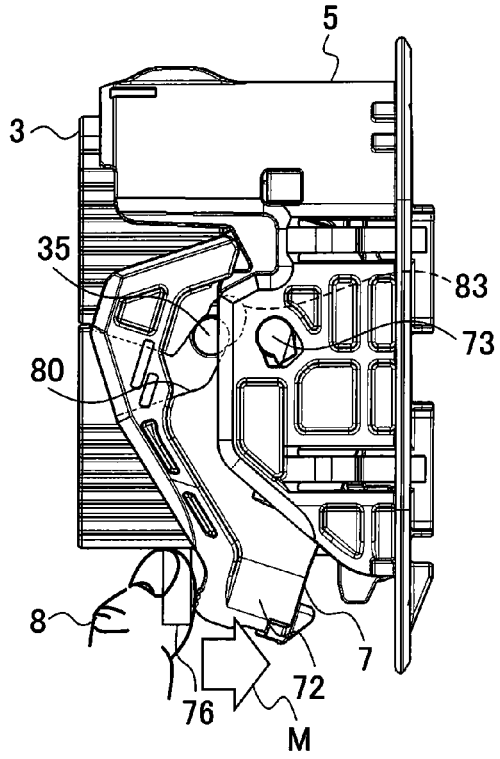
FIGS. 26(A) and 26(B) are a side view and cross-sectional view respectively showing rotating operation to the lever (action 6).
Figure 26:
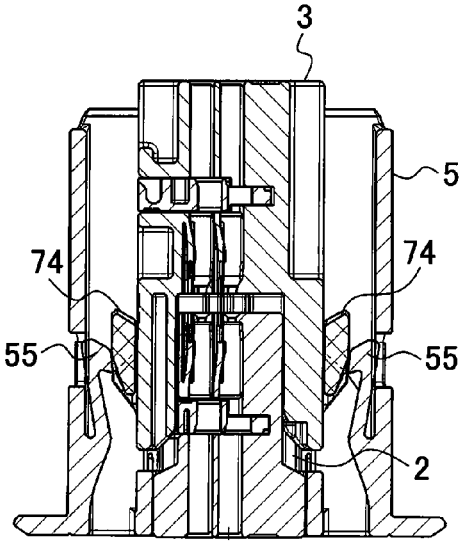
Figure 27:
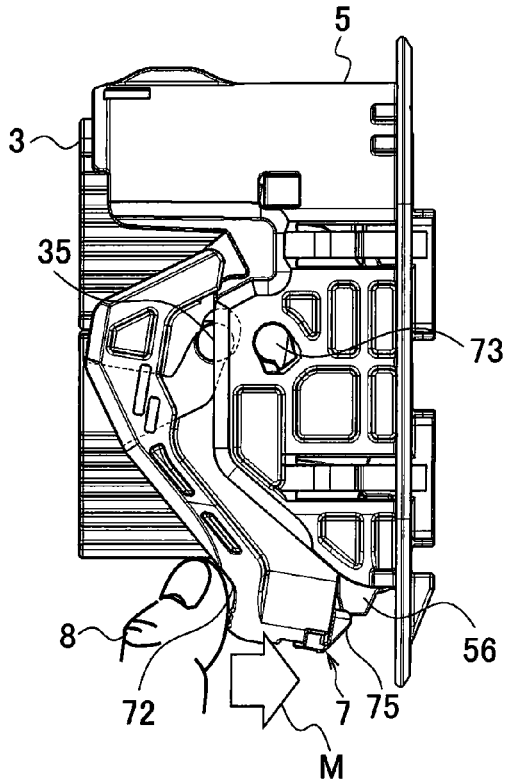
FIGS. 27(A) and 27(B) are a side view and cross-sectional view respectively showing the state following FIGS. 26(A) and 26(B) (action 7).
Figure 27:
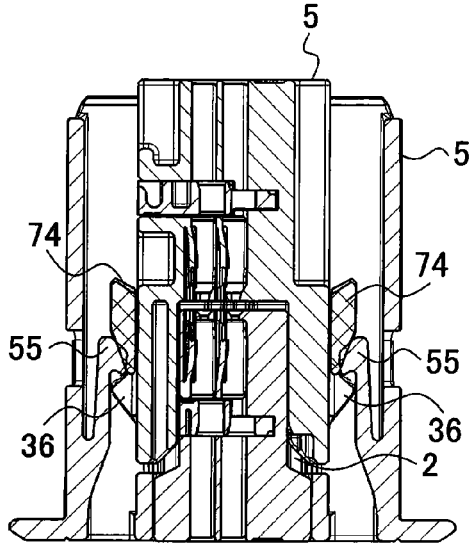
Figure 28:
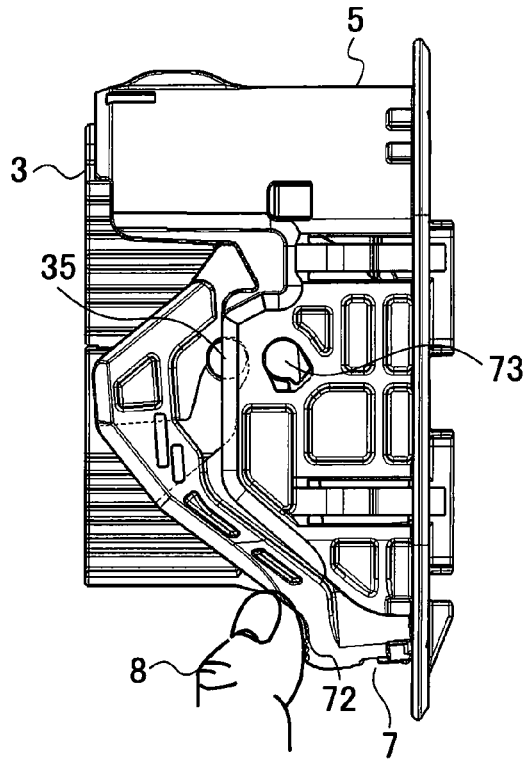
FIGS. 28(A) and 28(B) are a side view and cross-sectional view respectively showing a state in which fitting of the male connector (action 8) is complete.
Figure 28:
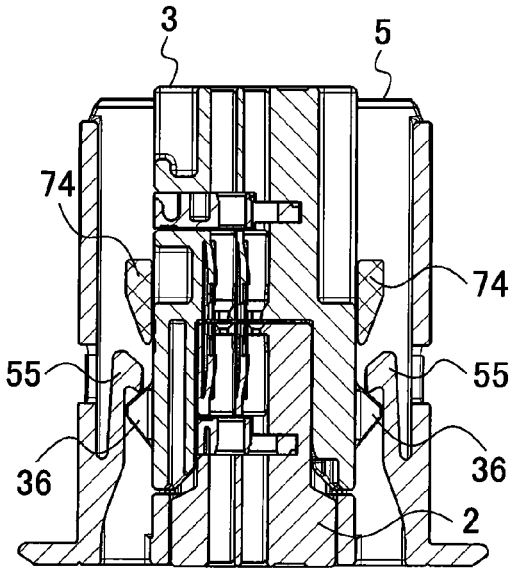

FIG. 19 and FIG. 20 show the structure in which reverse rotation prevention portions 11 for the lever 7 are provided. The reverse rotation prevention portions 11 prevent the lever 7 from rotating in the opposite direction opposite to the fitting rotation direction beyond the rotating operation range.

In FIG. 19, the reverse rotation prevention portions 11 are provided in the portions opposed to the pair of arm plates 71 of the lever 7 in the hood 5. Specifically, corresponding to projection portions 77 formed on the pair of arm plates 71 of the lever 7 so as to protrude, projection portions protruding toward the lever 7 are formed in the collar-like plate portion 51 of the hood 5, and are rendered to be the reverse rotation prevention portions 11. When the lever 7 rotates in the opposite direction opposite to the fitting rotation direction, the projection portions 77 of the lever 7 come into contact with the reverse rotation prevention portions 11 of the hood 5, and reverse rotation of the lever 7 beyond the rotating operation range can be prevented by the contact.

In FIG. 20, the reverse rotation prevention portions 11 are provided in the coupling cover portion 53 of the hood 5. The end face 59 of the coupling cover portion 53 of the hood 5 face to the end faces 78 of the pair of arm plates 71 of the lever 7, and the end face 59 is rendered to be the reverse rotation prevention portions 11 by being thickened as compared with the end faces 78 of the arm plates 71. When the lever 7 rotates in the opposite direction opposite to the fitting rotation direction, the end faces 78 of the lever 7 come into contact with the reverse rotation prevention portions 11 (end face 59) of the hood 5, and reverse rotation of the lever 7 beyond the rotating operation range can be prevented by the contact.

Since it is possible to prevent the reverse rotation of the lever 7 by providing the reverse rotation prevention portions 11 as described above, the lever 7 does not conflict and interfere with the male connector 3 when the male connector 3 is fitted through rotating operation of the lever 7, by which the workability of fitting the male connector 3 is improved.

The present invention has been described based on an embodiment, but the present invention is not limited to such an embodiment and the component of each unit can be replaced by a unit of any configuration having a similar function.

The entire content of Japanese Patent Application No. 2011-147440 (filing date: Jul. 1, 2011) is incorporated herein by reference.

The invention claimed is:

1. A lever-fitting-type connector comprising:

a female connector comprising a female connector housing having a terminal of a wire end housed in the female connector housing;

a male connector comprising a male connector housing configured to house a partner terminal of a wire end to be connected to the terminal housed in the female connector housing, the male connector housing fitted into the female connector being configured to connect the terminal of the wire end to the partner terminal of the wire end;

a hood for the female connector to be mounted and for the male connector to be inserted;

a lever rotatably assembled on the hood and configured to selectively apply a fitting force and a separation force between the male connector and the female connector by a rotating operation of the lever, wherein the male connector comprises a lever drawing-in boss, the lever comprises a boss drawing-in groove for the lever drawing-in boss to be drawn by a rotating operation of the lever, and the boss drawing-in groove comprises a lever inversion groove portion configured to cause the lever drawing-in boss to rotate the lever in an opposite direction opposite to a fitting rotation direction for the male connector to be fitted into the female connector, in response to an insertion of the male connector into the hood with the lever being positioned at an initial rotation position, a drawing-in groove portion configured to guide the lever drawing-in boss by a rotating operation of the lever in the fitting rotation direction and cause the male connector to be fitted into the female connector, and a lever inertial rotation portion provided in between the lever inversion groove portion and the drawing-in groove portion and configured to rotate in the fitting rotation direction due to an inertial force of the lever after rotation of the lever in the opposite direction and cause the lever drawing-in boss to move to the drawing-in groove portion.

2. The lever-fitting-type connector according to claim 1, wherein an inner wall of the hood comprises a lever temporary engagement arm being flexible and enabling the lever to be engaged at the initial rotation position, the lever comprises a lever temporary engagement holding portion configured to temporarily engage with the lever temporary engagement arm and hold the lever at the initial pivot position, the male connector comprises a lever temporary engagement release lug configured to warp the lever temporary engagement arm in response to insertion of the male connector into the hood with the lever being positioned at the initial rotation position and release a temporary engagement between the lever temporary engagement arm and the lever temporary engagement holding portion, and the lever drawing-in boss is positioned at the lever inertial rotation portion upon release of the temporary engagement between the lever temporary engagement arm and the lever temporary engagement holding portion in response to the insertion of the male connector into the hood with the lever being positioned at the initial rotation position.

3. The lever-fitting-type connector according to claim 1, wherein the lever comprises a pair of arm plates each having a pivot support axis provided to protrude from an outer peripheral surface of the arm plate, and an operating portion coupling the pair of arm plates and for performing the rotating operation with the operating portion being rotatably supported by the hood, each of the pair of arm plates comprises the boss drawing-in groove on toward the inner wall, and the lever inversion groove portion comprises a drawing-in inlet for the lever drawing-in boss of the male connector to be inserted, and an inclined wall inclined downward along a direction for the male connector to be fitted into the female connector and configured to be in contact with the lever drawing-in boss inserted from the drawing-in inlet.

4. The lever-fitting-type connector according to claim 3, wherein the hood comprises a lever lock engagement portion, and the operating portion of the lever comprises a lever lock configured to engage with the lever lock engagement portion upon completion of a fit between the male connector and the female connector.

* * * * *